US008642161B2

(12) United States Patent
Kuntz et al.

(10) Patent No.: US 8,642,161 B2
(45) Date of Patent: Feb. 4, 2014

(54) OPTICALLY VARIABLE SECURITY ELEMENT

(75) Inventors: Matthias Kuntz, Seeheim-Jugenheim (DE); Dieter Heinz, Heppenheim (DE); Ute Honeit, Darmstadt (DE); Burkhard Krietsch, Dieburg (DE)

(73) Assignee: Merck Patent GmbH, Darmstadt (DE)

( * ) Notice: Subject to any disclaimer, the term of this patent is extended or adjusted under 35 U.S.C. 154(b) by 696 days.

(21) Appl. No.: 12/517,155

(22) PCT Filed: Nov. 8, 2007

(86) PCT No.: PCT/EP2007/009701

§ 371 (c)(1),
(2), (4) Date: Jun. 1, 2009

(87) PCT Pub. No.: WO2008/067887

PCT Pub. Date: Jun. 12, 2008

(65) Prior Publication Data

US 2010/0072739 A1 Mar. 25, 2010

(30) Foreign Application Priority Data

Dec. 6, 2006 (DE) ..... 10 2006 057 507

(51) Int. Cl.
*B42D 15/10* (2006.01)

(52) U.S. Cl.
USPC ..... 428/195.1; 428/211.1; 427/162; 283/58; 283/70; 283/91

(58) Field of Classification Search
USPC ..... 428/195.1, 211.1; 283/70, 58, 91; 427/162
See application file for complete search history.

(56) References Cited

U.S. PATENT DOCUMENTS

| | | | | |
|---|---|---|---|---|
| 5,364,689 | A * | 11/1994 | Kashiwagi et al. | 428/195.1 |
| 5,424,119 | A * | 6/1995 | Phillips et al. | 428/328 |
| 5,766,738 | A * | 6/1998 | Phillips et al. | 428/200 |
| 6,114,018 | A | 9/2000 | Phillips et al. | |
| 2006/0097515 | A1 * | 5/2006 | Raksha et al. | 283/91 |
| 2008/0054621 | A1 * | 3/2008 | Burchard et al. | 283/72 |

FOREIGN PATENT DOCUMENTS

| | | | |
|---|---|---|---|
| DE | 10 2004 039 355 | A1 | 2/2006 |
| WO | WO 96/39307 | A1 | 12/1996 |

OTHER PUBLICATIONS

International Search Report of PCT/EP2007/009701 (Aug. 26, 2008).

* cited by examiner

*Primary Examiner* — Mark Ruthkosky
*Assistant Examiner* — Christopher Polley
(74) *Attorney, Agent, or Firm* — Millen, White, Zelano & Branigan, P.C.

(57) ABSTRACT

The present invention relates to an optically variable security element for protecting articles against counterfeiting, to a process for the production of a security element of this type, and to the use thereof.

37 Claims, No Drawings

OPTICALLY VARIABLE SECURITY ELEMENT

The present invention relates to an optically variable security element which can be employed as visible element for protecting articles against counterfeiting, to a process for the production of a security element of this type, and to the use thereof.

Security products, such as banknotes, cheques, credit cards, shares, passports, identity documents, driving licences, entry tickets, revenue stamps and the like, have for many years been provided with various security elements which are intended to make counterfeiting of these products more difficult.

For security products which are accessible to a broad public, use is frequently made of a plurality of different visible (overt) security elements, which are generally detectable without or only with minor aids by the so-called "man on the street". However, security products are preferably provided with various security elements which belong to different security classes. It is a major advantage here for one and the same security element simultaneously to belong to a plurality of security classes or to have a plurality of different detectable security features. This is the case, for example, if the security element has a plurality of visible security features which are different from one another or has a visible security feature and at least one further security feature which is only perceptible using aids. The last-mentioned case involves a combination of an overt security feature and a covert security feature. It is particularly desirable if a security element of this type having a plurality of security features can be produced in a simple, preferably single, process step.

In order to produce the overt visible security features, coloured security elements are frequently employed. In recent years, so-called optically variable security features, for example, have become established. These change their optical appearance with changing illumination and/or viewing angle. Examples thereof are holograms or also security features which change their colour and/or their brightness impression depending on the angle.

In general, optically variable security features are obtained by the deposition of multiple layers, each of which has different refractive indices, on suitable substrate surfaces, or by the incorporation of optically variable pigments into suitable support materials or by the application of coating compositions comprising optically variable pigments to substrate surfaces.

For example, U.S. Pat. No. 4,434,010 discloses optically variable pigments which can be employed in coating compositions for the production of counterfeiting-proof optically variable colour effects. These pigments consist of a plurality of predominantly metallic layers having different refractive indices and are produced in a complex and expensive evaporation process. Owing to their metal core, however, they are only obtainable in opaque form. A common use with optically invisible security features has not been described.

Pigments of this type are also employed in order to produce a plurality of optically variable structures alongside one another in security elements. Thus, for example, WO 96/39307 describes a paired optically variable device which comprises optically variable structures arranged alongside one another on a substrate which have the same colour under a certain illumination angle, but have different colours under all other illumination angles. Although it is on the one hand unclear what precisely is meant by "a certain illumination angle" and the human eye hardly appears suitable for the determination of the same colour, it also additionally proves, on the other hand, extremely difficult to provide two different pigments, interference layer sequences or the like which, alongside one another, convey the impression of "the same colour" to the highly sensitive human eye under one particular angle, but have different colours under all other angles. Although this difficulty contributes to the counterfeiting security of the security elements produced in this way, it also ensures, however, that the choice of usable materials is very restricted to the manufacturer, in particular with respect to the colour scheme, and that adaptation work must be carried out, in some cases at great effort, in order to be able to produce the state of "the same colour" even only to an approximation in the case of the paired device. The use of security elements of this type in mass-produced articles, such as, in particular, bank notes, is therefore too expensive, too complicated and not variable enough.

EP 490 825 B1 discloses a security paper which is provided in various surface regions with an ink application which comprises various iridescent pigments in the various regions, where the ink application is virtually invisible when viewed directly, but the ink application has a different colour in the various surface regions when viewed under at least one oblique viewing angle. The iridescent pigments used are preferably $TiO_2$-coated mica flakes, where various colours can be generated by means of a different layer thickness of the $TiO_2$ layer. The additional use of covert security features in the ink application has not been described.

If the different ink applications from EP 490 825 B1 are used as security feature, however, the fact that they are virtually invisible when viewed directly may also be disadvantageous. A security feature of this type will only be noticed by the examining person after viewing the security paper a number of times under different angles. If, in addition, the colour effect is relatively weak, as is to be expected in the case of the pigments described, it will be necessary for comparatively large areas to be provided with the various ink applications in order that they are perceived at all as a security feature. Relatively complicated patterns with relatively small areas will consequently not be usable in practice, and the "man on the street" will not always be able readily to detect the security feature.

U.S. Pat. No. 5,009,486 describes a security feature which comprises a shaped coating and a larger-area coating adjacent thereto on a substrate, where the shaped coating comprises at least one transparent optical interference layer and where the coatings, when viewed from a certain angle, have a colour difference which arises through different reflection or transmission of the light by the various coatings.

The shaped transparent optical interference layer is produced by evaporation of suitable materials through suitable masks, by laser ablation of layers that have already been vapour-deposited, laser-activated CVD or similarly complicated processes. These processes are complex, expensive and include no means for correction of the colour setting during the production process. In addition, they do not allow additional, invisible features to be incorporated into the coating as well.

The object of the present invention therefore consisted in providing an optically variable security element which comprises at least two part-areas which can be distinguished from one another, can be readily detected by the so-called "man on the street" at any selected illumination and/or viewing angle, allows small-area patterns with good visibility, allows the possibility of integration of invisible features into the part-areas, can be obtained by means of a simple and inexpensive production process and is versatile to use.

A further object of the invention consisted in providing a process for the production of a security element of this type.

A further object of the invention consisted in indicating the use of the said security feature.

The object of the present invention is achieved by an optically variable security element which comprises a substrate which has on at least one surface a coating which consists of at least two coloured part-areas adjacent to one another which can be distinguished from one another and are simultaneously visible to the eye, where the part-areas comprise inorganic flake-form effect pigments or in-situ polymerised and/or crosslinked mesogenic materials, and at least one of the part-areas has different colours depending on the illumination and/or viewing angle, and where the colours of at least two of the part-areas are different from one another under any illumination and/or viewing angle.

Furthermore, the object of the invention is achieved by a process for the production of a security element in which at least two different coating compositions are applied to at least one surface of a substrate in such a way that a coating is formed from at least two adjacent part-areas which can be distinguished from one another, where the coating compositions comprise inorganic flake-form effect pigments or in-situ polymerisable and/or crosslinkable mesogenic materials, which are selected so that at least one of the part-areas of the coating has different colours depending on the illumination and/or viewing angle, and the colours of at least two of the part-areas are different from one another under any illumination and/or viewing angle, and the coating is optionally solidified.

In addition, the object of the invention is achieved by the use of the security element described for protecting articles against counterfeiting.

The present invention furthermore relates to banknotes, cheques, credit cards, shares, passports, identity documents, driving licences, entry tickets, revenue stamps, ID cards, travel tickets, postage stamps, packaging materials, seals, labels or articles of daily use to be protected, which are protected against counterfeiting using the said security element.

For the purposes of the present invention, optically variable security elements are those which leave behind a different visible colour impression under different illumination and/or viewing angles at least on one of their part-areas. This is also known as colour flop. These security elements exhibit non-copyable colour and gloss impressions which are readily visible with the naked eye. The security elements preferably have at least two and at most four optically clearly distinguishable discrete colours under at least two different illumination or viewing angles, but in particular two optically clearly distinguishable discrete colours under two different illumination or viewing angles or three optically clearly distinguishable discrete colours under three different illumination or viewing angles. This property makes it easier for the viewer on the one hand to recognise the security element as such and simultaneously makes copying of the feature more difficult since colour flop effects cannot be copied and reproduced in commercially available colour copiers.

Security elements which have a colour graduation on tilting through various illumination and/or viewing angles can likewise be employed, since diffuse colour changes of this type are also readily visible to the human eye.

The security element according to the invention has a substrate, which is a paper, a board, a polymeric material, a textile material, a metallic material, leather, wood or a composite material comprising at least two of these materials. The composite material here may consist of at least two materials of identical or different types, i.e., for example, polymeric materials can form a composite material with one another or one or more polymeric materials can form a composite material with one or more paper materials. All customary types of paper, in particular security papers, preferably security papers having a grammage of up to 200 g/m$^2$, polymeric materials, such as polymer films, and composite materials made therefrom, for example the plastic cards usually employed for security purposes, are preferred.

The substrate for the security element according to the invention may be transparent, semitransparent or opaque to visible light.

The substrates have at least one surface, which itself has a coating which consists of at least two adjacent coloured part-areas which can be distinguished from one another.

For the purposes of the invention, adjacent here means that at least two of the part-areas have such a small separation from one another that they are simultaneously visible to the eye or if necessary a reading instrument in focus, where both part-areas preferably have at least one common boundary line or are connected to one another by a common boundary area. The part-areas are thus either directly alongside one another, i.e. they share at least one boundary line, or are delimited from one another by a boundary area which does not significantly impair the optical impression. This can be, for example, a border or another area of neutral colour. This boundary area does not have to comprise any flake-form effect pigments or liquid-crystalline compounds, but instead can be, for example, a conventional coating comprising absorbent dyes. It is important that the part-areas are arranged close to one another in such a way that they can simultaneously be in the focus of the viewer on examination of the security element.

It goes without saying that the above details apply to the human eye, more specifically the eye of a person with colour vision.

The term coloured part-areas is applied to areas which have a colour, but not white, grey or black areas, with the exception that part-areas coated with nematic mesogenic compounds may also merely have the colour of the substrate, in this case preferably reflective, which may have a silver, gold or other metallic lustre.

At least two of the part-areas comprise flake-form effect pigments or in-situ crosslinked and/or polymerised mesogenic compounds.

The security element according to the invention is constructed in such a way that these part-areas have colours which are different from one another under any illumination and/or viewing angle. The person with colour vision mentioned above who looks at the security element under constant illumination conditions is regarded as the standard for visible optical assessment of the security element according to the invention. The viewing should generally be possible without aids. Simple magnifying devices, such as spectacles, magnifying glasses and the like are not regarded as aids here, i.e. their use is regarded as a normal condition.

The human eye is highly sensitive and is therefore capable of detecting a larger colour space than can be generated using current processes, for example printing processes. In particular, colour differences are detected even in small graduations. A person with colour vision will therefore be able to detect even slight, gradual brightness graduations of the same hue as "different colours". However, this special feature of human colour perception is not important here. Rather, "different colours" are regarded as being those which can clearly be detected as "different" by the untrained viewer, i.e. the so-called "man on the street" when viewed briefly. This is always the case if different hues are detected, for example orange, red or magenta, if significant brightness differences can be noted, for example a bright orange hue compared with a saturated copper hue, but in particular if high colour contrast is evident, for example between magenta and yellow.

The highest colour contrast arises if complementary colours are perceived simultaneously alongside one another, since the human eye reproduces colour contrasts disproportionately. Complementary colours are the colours which are directly opposite the primary colours in the colour wheel. In the red-green-blue colour wheel (RGB colour wheel), these are red/cyan, green/magenta and blue/yellow. The same applies to the mixed colours.

Owing to better detectability, it is therefore preferred for the different colours of the part-areas in the present security element to have high colour contrast or, likewise preferably, to be complementary colours to one another.

Suitable illumination and viewing angles are all angles between 0° (direct plan view) and 90° (widest possible inclined view). Both the illumination angle and the viewing angle can be varied. However, it is possible to vary either the illumination angle or the viewing angle with the other angle constant. The viewer can easily achieve this by, for example, moving the security element towards himself, away from himself or also tilting it to the side or bringing it into various positions relative to a fixed light source. It is also possible to change the relative position of the light source, although this is generally accompanied by greater effort.

It is self-evident that the illumination or viewing angle is not measured by the "man on the street" under the practical conditions of the examination. It is therefore immaterial whether the angles with integer or decimal angle degrees are involved. It is important that both part-areas are simultaneously visible to the viewer under the same condition, as far as possible in the focus of the field of view.

At least one of the part-areas has different colours depending on the illumination and/or viewing angle. As already described above, such behaviour is known as colour flop. As described above, this may involve either different discrete colours under different angles, or a continuous colour graduation in the case of a changing illumination and/or viewing angle. The part-area thus has so-called optically variable behaviour. This part-area exhibits different colours when viewed under different angles, while an adjacent part-area which satisfies the requirements described above in the simplest case always has the same colour under different viewing angles, but this colour is always different from the respective colour of the optically variable part-area.

However, at least two part-areas of the coating preferably have different colours under different illumination and/or viewing angles, i.e. a colour flop.

Preference is likewise given to an embodiment of the present invention in which all part-areas of the coating have different colours under different illumination and/or viewing angles.

In particular, the security element according to the invention is constructed in such a way that in each case two adjacent part-areas of the coating have different colours under different illumination and/or viewing angles. These are preferably part-areas which are located directly alongside one another and have at least one common boundary line. Arrangements of the part-areas in which one of the part-areas forms optically the background for a smaller part-area included therein also have a common boundary line of this type. The appearance of three part-areas, of which the first and third each have the same colour under a certain illumination and/or viewing angle, but the second part-area lying in between in each case has a different colour to the two adjacent part-areas, arises here on viewing of a longitudinal axis of the security element.

A preferred embodiment of the present invention consists in that the first part-area has a first colour under a first illumination and/or viewing angle and a second colour under a second illumination and/or viewing angle which is different therefrom, while the second part-area has the said second colour under the first viewing angle and the said first colour under the second viewing angle. The colour behaviour of the two part-areas is thus opposite to one another. The security element is particularly readily visible if the colours used have high colour contrast.

If the entire security element as a whole has only two different hues, impressive colour plays can be generated by the colour contrast without the viewer becoming confused.

Examples of colour schemes of this type are a red/gold colour flop for the first part-area and a gold/red colour flop for the second part-area, just as the combination of gold/green with green/gold, blue/green with green/blue and so on.

In a preferred variant of this embodiment, at least two part-areas of the coating are selected in such a way that, under a first illumination and/or viewing angle, the first part-area has a colour which corresponds to the complementary colour of the second part-area, and, under a second illumination and/or viewing angle which is different therefrom, the first and second part-areas each have a colour which corresponds to the complementary colour of the colour that these areas each have under the first viewing angle.

For example, one of the part-areas may thus have a yellow colour under a certain viewing angle, while a second part-area has a blue colour under this viewing angle. The first part-area then has a blue colour under a second viewing angle which is different from the first viewing angle, while the second part-area has a yellow colour. This example can be repeated with green/magenta, red/cyan or the mixed colours in the colour wheel. Since complementary colours, as already mentioned above, in each case have the greatest possible colour contrast to one another and the human eye perceives colour contrasts particularly well, this colour combination is particularly suitable for attracting high attention and thus being readily visible and detectable, even in the case of small-area security elements or patterns with small area units.

Both in the case of the part-areas which have complementary colours to one another and in the case of the other part-areas having high contrast which exhibit opposite colour behaviour under various angles, the advantage arises for the production of the individual areas that the pigments or mesogenic compounds employed, which are employed to achieve the optically variable colour effects, need only be matched to one another so that the respective hue is clearly evident. For example, the red and gold hues in a gold/red colour flop on one part-area and a red/gold colour flop on the other part-area need not be identical since the two red hues or the two gold hues are never evident simultaneously. The manufacturer is thus offered broader possibilities in the choice of suitable pigments or mesogenic materials and possible colour schemes without neglecting the security aspect.

Since colour contrasts are particularly evident directly alongside one another, the part-areas in the embodiments described above are preferably adjacent to one another, in particular directly adjacent to one another with at least one common boundary line.

Since the number of part-areas of the security element according to the invention is limited only by economic considerations or space requirements to be observed, it is readily possible to obtain security elements in accordance with the present invention which exhibit, for example, the same or an opposite colour effect or different optically variable effects on a substrate of the same colour in an alternating and recurring manner. This gives rise to a wide variety of readily visible designs.

Depending on the hiding power of the flake-form effect pigments or liquid-crystalline compounds employed, it may be appropriate to enhance the colour impression achievable thereby by specific selection or pre-coating of the substrate on the entire coated part-area or part thereof. For the purposes of the invention, this can be carried out by all or part of the substrate having a black, grey or other dark colour beneath the coating forming the part-areas. As already mentioned, this colouration of the substrate may be intrinsic, i.e. the substrate may per se have a dark and thus at least partially absorbent coloration, or the substrate is provided with a corresponding pre-coating. This may, as usual, consist of absorbent dyes or coloured pigments in a suitable binder, optionally with further additives. For the purposes of the invention, a dark coloration is intended to be taken to mean all conventional dark hues which have a strongly absorbent action, i.e. various dark-red, dark-blue, darkgreen, dark-violet and dark-brown shades, etc. The latter influence not only the good visibility of the security element according to the invention, but also, through their inherent colour, the colour scheme of the part-areas applied thereto, as far as these comprise at least partially transparent flake-form effect pigments or transparent polymerised or crosslinked liquid-crystalline materials. By contrast, black and grey substrates only enhance the colour impression that can be generated directly with the materials present in the part-areas located thereon.

An enhancement of the colour impression generated by the flake-form effect pigments or mesogenic materials used in the coating can also be achieved by specific admixing of black, grey or dark-coloured colorants directly in the coating. Such colorants may consist of organic or inorganic pigments or soluble dyes. In the case of inorganic pigments, they may likewise be flake-form effect pigments.

In particular on use of nematic liquid-crystalline materials as polymerisable and/or crosslinkable mesogenic material for the coating of a part-area, it may be advantageous to employ a fully or partly reflective substrate instead of an absorbent substrate. Here too, an intrinsically reflective substrate can be employed, or one of the said substrates is provided fully or partly with a reflective pre-coating. Suitable reflective substrates are described in greater detail below.

It is likewise possible here to supplement or replace a reflective substrate by the addition of reflective flake-form pigments directly in the coating.

For the purposes of the invention, inorganic flake-form effect pigments are flake-form pearlescent pigments, predominantly transparent or semitransparent interference pigments and metal-effect pigments, or mixtures of two or more of these pigments. These flake-form pigments are built up from one or more layers of optionally different materials.

Pearlescent pigments consist of transparent flakes of high refractive index and exhibit a characteristic pearlescence on parallel alignment due to multiple reflection. Pearlescent pigments of this type which additionally also exhibit interference colours are known as interference pigments.

Although classical pearlescent pigments, such as $TiO_2$ flakes, basic lead carbonate or BiOCl pigments, are of course in principle also suitable, the inorganic flake-form effect pigments employed for the purposes of the invention are preferably interference pigments or metal-effect pigments which have at least one coating comprising a metal, metal oxide, metal oxide hydrate or mixtures thereof, a metal mixed oxide, metal suboxide, metal oxynitride, metal fluoride, BiOCl or a polymer on an inorganic flake-form support. The metal-effect pigments preferably have at least one metal layer.

The inorganic flake-form support preferably consists of natural or synthetic mica, kaolin, talc or another phyllosilicate, glass, $SiO_2$, a borosilicate, graphite flakes, $Al_2O_3$, another metal oxide, such as, for example, $Fe_2O_3$ or $TiO_2$, or metal flakes, such as, for example, aluminium, titanium, bronze, silver, copper, gold, steel or diverse metal alloys.

Particular preference is given to supports comprising mica, glass, graphite, $SiO_2$, $TiO_2$ and $Al_2O_3$ or mixtures thereof.

The size of these flake-form supports is not crucial per se. They generally have a thickness between 0.01 and 5 μm, in particular between 0.05 and 4.5 μm. The length and width dimension is usually between 1 and 250 μm, preferably between 2 and 200 μm and in particular between 2 and 100 μm. They generally have an aspect ratio (ratio of diameter to particle thickness) of 2:1 to 25,000:1, and in particular 3:1 to 2000:1.

A coating applied to the support preferably consists of metals, metal oxides, metal oxide hydrates or mixtures thereof, metal mixed oxides, metal sub-oxides or metal fluorides and in particular colourless or coloured metal oxides selected from $TiO_2$, titanium suboxides, titanium oxynitrides, $Fe_2O_3$, $Fe_3O_4$, $SnO_2$, $Sb_2O_3$, $SiO_2$, $Al_2O_3$, $ZrO_2$, $B_2O_3$, $Cr_2O_3$, ZnO, CuO, NiO or mixtures thereof, or the associated hydrates.

Metal coatings preferably comprise aluminium, titanium, chromium, iron, nickel, silver, zinc, molybdenum, tantalum, tungsten, palladium, copper, gold, platinum or alloys comprising these.

Also particularly suitable are coatings comprising metal oxides which comprise metals, for example coatings which comprise metallic iron, preferably mixed with FeO and/or $F_3O_4$.

The metal fluoride employed is preferably $MgF_2$.

The inorganic flake-form effect pigments employed are single-layered effect pigments, i.e. flake-form support materials coated with a layer of one of the above materials, but particularly preferably multilayered effect pigments. These have, on a flake-form, preferably nonmetallic support, a plurality of layers, which preferably consist of the above-mentioned materials and have different refractive indices in such a way that in each case at least two layers of different refractive index are located alternately on the support, where the refractive indices in the individual layers differ by at least 0.1 and preferably by at least 0.3. The layers located on the support may be either virtually transparent or coloured or semitransparent. It is particularly preferred to employ pigments in which the layer(s) on the flake-form support material sheath(s) the latter substantially completely.

The flake-form effect pigments described above may be present individually or in the form of a mixture in the coating in the security element in accordance with the present invention.

In a preferred embodiment of the present invention, the flake-form effect pigments are preferably transparent or semitransparent, i.e. they transmit at least 10% of the incident light. Flake-form effect pigments of this type are preferably used since their transparency in a security product which has a security element in accordance with the present invention contributes to a wide variety of possible background or substrate colours, as already mentioned above.

In a further, likewise preferred embodiment of the present invention, however, it is advantageous to employ a flake-form effect pigment which has at least one metal layer or a layer having a metallic content. The pigments comprising metallic iron mentioned above are preferably employed here. However, other pigments comprising metal layers, in particular also those comprising metallic support flakes, are also suitable. Such pigments are generally virtually opaque to incident light and thus have a very high hiding power. Any angle-dependent colour changes (colour flops) which can be generated therewith are therefore readily visible without the need to employ a black or dark-coloured substrate.

If the different colours of one or more of the part-areas of the security element according to the invention that are obtained under different illumination and/or viewing angles are to be achieved by the flake-form effect pigments, flake-form effect pigments are employed which leave behind a different visible colour and/or brightness impression, i.e. have a colour flop, or, in other words, are optically variable, under different illumination and/or viewing angles. The colour impression which is different depending on the angle results from pigment interference colours which are different depending on the angle and optionally interact with any absorption colours of these pigments which may also result.

For the purposes of the invention, the optically variable flake-form effect pigments preferably have at least two and at most four optically clearly distinguishable discrete colours under at least two different illumination or viewing angles, but preferably two optically clearly distinguishable discrete colours under two different illumination or viewing angles or three optically clearly distinguishable discrete colours under three different illumination or viewing angles. In each case, only the discrete hues and no intermediate stages are preferably present, i.e. a clear change from one colour to another colour is evident on tilting of the security element which comprises the optically variable pigments.

However, it is of course also possible to employ optically variable flake-form effect pigments which have a colour graduation on tilting through various illumination and/or viewing angles.

The optical properties of the flake-form effect pigments thus determine the optical properties of the part-area coating comprising them. Since not all of the part-areas have to have an angle-dependent colour behaviour, the coating of the part-areas may also comprise exclusively flake-form effect pigments which are not optically variable in the sense described above, but instead have, for example, high tinting strength, satin effects, glitter effects and the like. It goes without saying that further effect pigments of this type may also be present in the coating of the part-areas referred to as optically variable in the form of a mixture with the optically variable effect pigments.

In order to be able to develop their full optical effect, it is advantageous for the flake-form effect pigments employed in accordance with the invention to be present in the coating in the security element in aligned form, i.e. they are aligned virtually parallel to the substrate of the security element. An alignment of this type generally already essentially takes place by means of the processes usually used for application of the security element, such as, for example, conventional printing or coating processes.

Flake-form effect pigments which can be employed are, for example, the commercially available interference pigments available under the names Iriodin®, Colorstream®, Xiralic®, Lustrepak®, Colorcrypt®, Colorcode® and Securalic® from Merck KGaA, Mearlin® from Mearl, metal-effect pigments from Eckhard and goniochromatic (optically variable) effect pigments, such as, for example, Variochrom® from BASF, Chromafflair® from Flex Products Inc., and other similar commercially available pigments. However, this list should merely be regarded as illustrative and not restrictive.

In addition, it is possible to incorporate the flake-form effect pigments with further additives into precursors in the form of, for example, pigment mixtures, masterbatches, pastes, slurries, granules, pellets and the like and to use the latter for the preparation of, for example, printing inks or other coating compositions, which may effect, in particular, processing simplifications.

The in-situ polymerised and/or crosslinked mesogenic material is a material which is obtained by in-situ polymerisation and/or crosslinking of polymerisable or crosslinkable mesogenic materials. Such materials are nematic, smectic or chiral-nematic (cholesteric) materials. Preference is given to the use of nematic or cholesteric materials, which in each case cause different optical effects in the security element according to the invention.

It is known that coatings which, when applied to an absorbent substrate, can result in angle-dependent colour changes of the applied layer can be obtained using cholesteric liquid-crystalline materials. The part-areas coated with in-situ polymerisable and/or crosslinkable cholesteric mesogenic materials employed in accordance with the invention may thus have angle-dependently variable (optically variable) colour effects merely through the use of these materials.

By contrast, nematic liquid-crystalline materials enable the production of coatings which, against a reflective background, are themselves colourless and thus visibly have the colour of the respective substrate. If, by contrast, suitable dyes, coloured pigments, effect pigments or the like are added to the nematic mesogenic materials employed in accordance with the invention or if they are applied to a coloured reflective substrate, they exhibit a uniform coloration when the security element is viewed without aids. If the part-areas of the security element according to the invention which are coated with nematic mesogenic materials are intended to have angle-dependent colours, it is necessary for them to be applied to a reflective substrate which has angle-dependent colours (optically variable) or for the coating composition to comprise optically variable flake-form effect pigments. The optically variable substrate may be, for example, a substrate pre-coated with optically variable flake-form effect pigments. The part-areas coated in this way have a hidden security feature which is only visible using a linear polariser, and optionally a visible coloured or optically variable (overt) security feature.

The cholesteric polymerisable mesogenic materials in accordance with the present invention are therefore applied to the coating part-area comprising them, preferably on a black, grey or dark-coloured substrate, which also need only be partly dark-coloured. By contrast, the nematic polymerisable mesogenic materials are preferably applied to an at least partly reflective substrate in the coating of the part-area.

The reflective substrate can be a metallic or metallised substrate, which preferably has one or more metal layers. Substrates of this type may also be surfaces of holograms, kinegrams or of hot-embossing films. Suitable metallic or metallised substrates are, for example, those with layers of Al, Cu, Ni, Ag, Cr or alloys, such as Pt/Rh or Ni/Cr. However, the reflective layers on the substrate may also be produced by application of a coating comprising reflective pigments. Particularly suitable reflective pigments here are metal pigments comprising aluminium, gold or titanium, but also the flake-form effect pigments already described above, which may likewise have highly reflective properties. This applies, in particular, to the said metal-effect pigments.

If reflective pigments of this type are added to the polymerisable nematic mesogenic material directly in the coating composition, these likewise form a reflective background in the coating without the substrate having to be made reflective separately.

For the purposes of the present invention, in-situ polymerisable or crosslinkable mesogenic materials are taken to mean those mesogenic materials which can be polymerised or crosslinked directly on a substrate. The substrate here can be either the substrate of the present security element or an auxiliary substrate, on which a film essentially consisting of mesogenic material and optionally suitable additives is cured and is subsequently applied with or without the auxiliary substrate in the form of a film to the substrate of the security element according to the invention. The latter is preferably carried out by means of an adhesive layer or in the form of a heat-sealing film.

The auxiliary substrate is preferably a polymeric substrate, a metallised polymeric substrate, a metallic substrate, a conventional transfer element, which is usually built up from a plurality of layers of suitable materials, such as polymer layers, paper layers, metal layers, adhesive layers, antiadhesion layers, etc., or the like.

The mesogenic material for the coating composition is preferably an in-situ polymerisable or crosslinkable material which polymerises and/or crosslinks during or after evaporation of a solvent and is present in the (in-situ) polymerised and/or crosslinked form in the security element in accordance with the present invention. It preferably comprises at least one polymerisable mesogenic compound which contains a polymerisable functional group and at least one further polymerisable mesogenic compound which contains two or more polymerisable functional groups.

For the purposes of the invention, mesogenic compounds or materials are taken to mean those which contain one or more rod-shaped, plank-shaped or disc-shaped mesogenic groups, i.e. those which are able to induce a liquid-crystalline behaviour. Such compounds may, but need not necessarily, themselves have liquid-crystalline phases. It is likewise possible for them to exhibit liquid-crystalline behaviour only in a mixture with other compounds or after polymerisation.

If the polymerisable material comprises polymerisable mesogenic compounds which contain two or more polymerisable functional groups (di- or multireactive or di- or multifunctional compounds), a three-dimensional network which is self-supporting and has high mechanical and thermal stability and low temperature dependence of its physical and optical properties is formed during the polymerisation. For example, the glass-transition temperature, which is important for mechanical stability, can be adjusted in a simple manner via the concentration of the multifunctional mesogenic compounds.

The polymerisable mesogenic mono-, di- or multifunctional compounds can be prepared by generally known methods. Such methods are described, for example, in Houben-Weyl, Methoden der organischen Chemie [Methods of Organic Chemistry], Thieme-Verlag, Stuttgart. Typical examples are disclosed in WO 93/22397; EP 0 261 712; DE 19504224; DE 4408171 and IDE 4405316. However, the compounds described therein serve merely for illustration and are not intended to be regarded as restrictive.

Examples of particularly suitable monoreactive polymerisable mesogenic compounds are shown in the following list of compounds. These serve for illustration of the invention and in no way for restriction thereof.

(Ia)

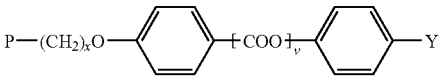

(Ib)

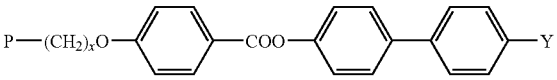

(Ic)

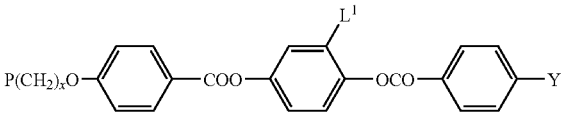

(Id)

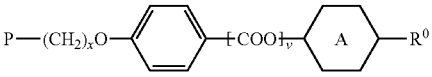

(Ie)

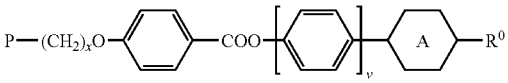

(If)

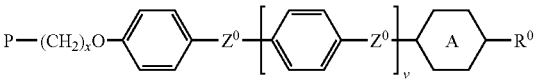

(Ig)

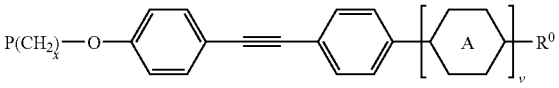

(Ih)

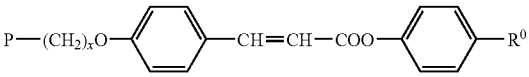

(Ii)

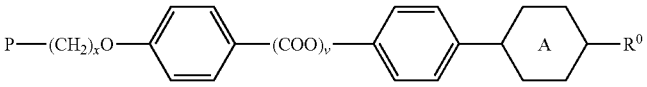

(Ik)

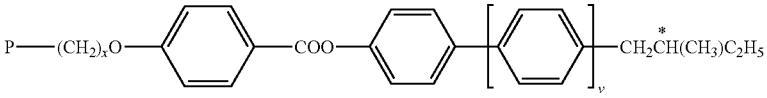

-continued (Im)

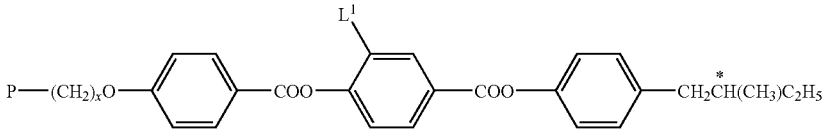

(In)

(Io)

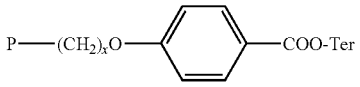

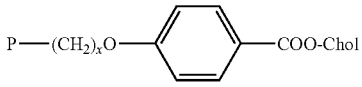

(Ip)

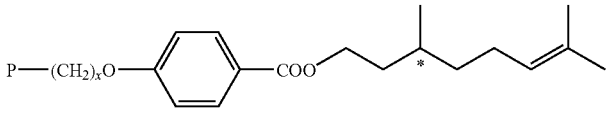

Examples of particularly suitable direactive polymerisable mesogenic compounds are shown in the following list, but should likewise not be regarded as restrictive.

In the formulae indicated above, P denotes a polymerisable group, preferably an acryl, methacryl, vinyl, vinyloxy, propenyl, ether, epoxide or styryl group, x and y, independently (IIa)

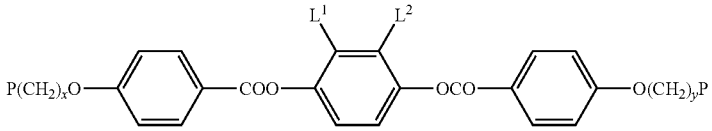

(IIb)

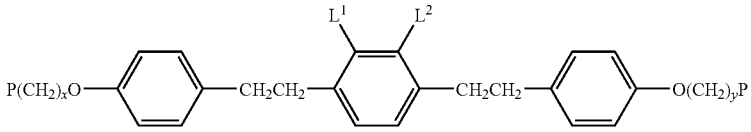

(IIc)

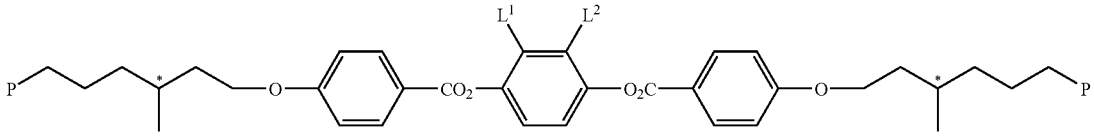

(IId)

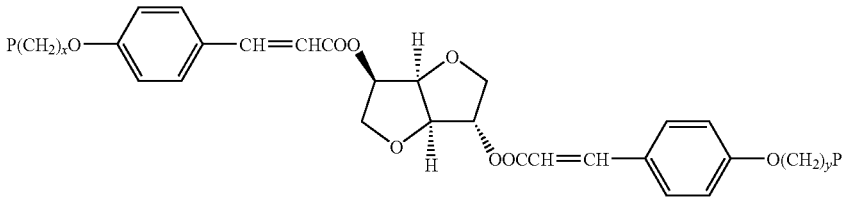

(IIe)

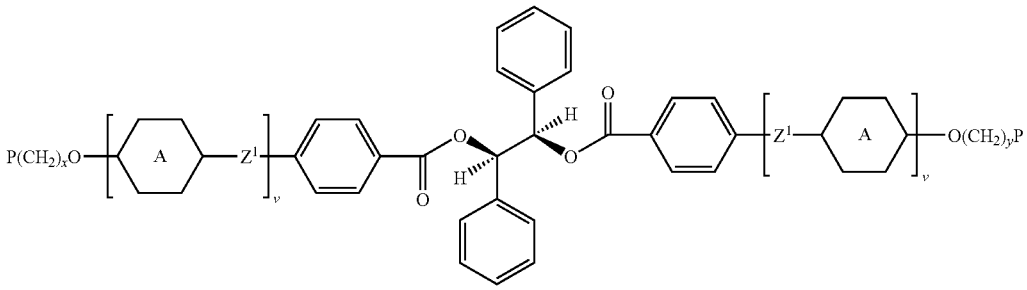

of one another, denote 1 to 12, A denotes 1,4-phenylene, which is optionally mono-, di- or trisubstituted by $L^1$, or denotes 1,4-cyclohexylene, v denotes 0 or 1, $Z^0$ denotes —COO—, —OCO—, —$CH_2CH_2$— or a single bond, Y denotes a polar group, Ter denotes a terpenoid radical, such as, for example, menthyl, Choi denotes a cholesteric group, $R^0$ denotes a nonpolar alkyl or alkoxy group, and $L^1$ and $L^2$ each, independently of one another, denote H, F, Cl, CN or an optionally halogenated alkyl, alkoxy, alkylcarbonyl, alkoxycarbonyl or alkoxycarbonyloxy group having 1 to 7 C atoms.

In this connection, the expression "polar group" denotes a group selected from F, Cl, CN, $NO_2$, OH, $OCH_3$, OCN, SCN, an optionally fluorinated carbonyl or carboxyl group having up to 4 C atoms or a mono-, oligo- or polyfluorinated alkyl or alkoxy group having 1 to 4 C atoms. The expression "nonpolar group" denotes an alkyl group having 1 or more, preferably 1 to 12 C atoms or an alkoxy group having 2 or more, preferably 2 to 12 C atoms.

If cholesteric liquid-crystalline materials (CLCs) are used, these preferably comprise a nematic or smectic host material and one or more chiral dopants which induce the helical twist of the host material. These chiral dopants may be polymerisable or not. Although they may be mesogenic or liquid-crystalline compounds, the dopants do not necessarily have to be liquid-crystalline.

Particular preference is given to chiral dopants having a high helical twisting power (HTP), in particular such as the compounds disclosed in the formulae I and IIa to IIk in WO 98/00428. Further chiral dopants which are typically used are, for example, the compounds available under the name S 1011, R 811 or CB 15 from Merck KGaA, Darmstadt.

Particular preference is given to chiral dopants of the following formulae:

Polymerisable chiral compounds are preferably selected from the compounds of the formulae Ik to Ip and IIc to IIe. It is likewise possible to select compounds of the formulae Ia to Ii in which $R^0$ or Y contains a chiral C atom.

The amount of the chiral dopants in the mesogenic material is preferably less than 15% by weight, in particular less than 10% by weight, particularly preferably less than 5% by weight, based on the total weight of the mesogenic material (without solvent).

The polymerisation of the polymerisable mesogenic material is effected by the action of heat or photochemically active radiation on the polymerisable material. Photochemically active radiation is taken to mean the influence of light, for example UV light, IR light or visible light, the influence of X-rays or gamma radiation or irradiation with high-energy particles, for example ions or electrons. The polymerisation is preferably carried out by means of UV irradiation. The radiation source used for this purpose can be a single UV lamp or also a set of UV lamps. The curing time can be reduced by high luminous intensity. A further source of photochemically active radiation can also be lasers, for example UV lasers, IR lasers or visible lasers.

The polymerisation is carried out in the presence of a polymerisation initiator which absorbs at the wavelength of the photochemically active radiation. If, for example, the polymerisation is carried out by means of the influence of UV light, it is possible to use a photoinitiator which is decomposed under the influence of UV radiation with formation of free ions or radicals which initiate the polymerisation reaction. If polymerisable mesogens containing acrylate or methacrylate groups are polymerised, a free-radical photoinitiator is preferably used. In the case of polymerisation of polymerisable mesogenic vinyl and epoxide groups, by contrast, a

III

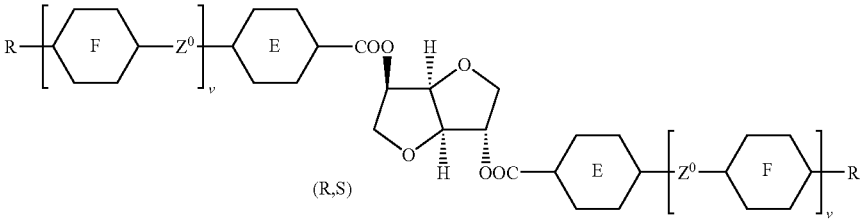

IV

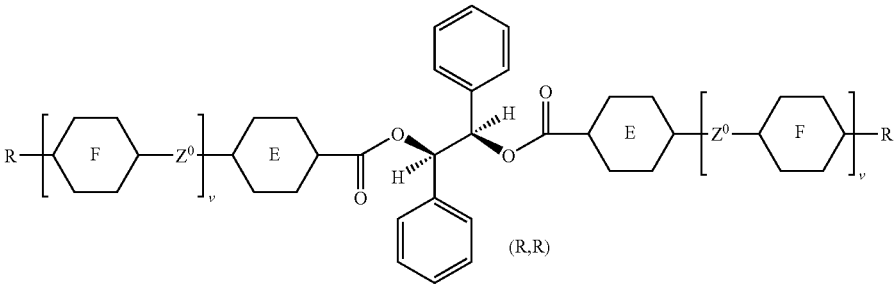

including the (R,S), (S,R), (R,R) and (S,S) enantiomers, which are not mentioned.

E and F here have, independently of one another, one of the meanings of A as described above, v denotes 0 or 1, $Z^0$ denotes —COO—, —OCO—, —$CH_2CH_2$— or a single bond, and R denotes alkyl, alkoxy, carbonyl or carbonyloxy having 1 to 12 C atoms.

The compounds of the formula III are described in WO 98/00428, while the synthesis of the compounds of the formula IV is disclosed in GB 2,328,207.

cationic photoinitiator is preferably used. It is likewise possible to use a polymerisation initiator which decomposes under the action of heat with formation of free radicals or ions which initiate the polymerisation.

The photoinitiator used for the free-radical polymerisation can be, for example, the commercially available compositions Irgacure 651®, Irgacure 184®, Darocur 1173® and Darocur 4205® (from Ciba Geigy AG), while cationic photopolymerisation can preferably be carried out using the commercially available initiator with the name UVI 6974®

(Union Carbide). The polymerisable liquid-crystalline material preferably comprises 0.01 to 10% by weight, in particular 0.05 to 5% by weight, and particularly preferably 0.1 to 3% by weight, of a polymerisation initiator. UV photoinitiators are preferred, in particular free-radical UV photoinitiators.

The curing time is dependent, inter alia, on the reactivity of the polymerisable mesogenic material, the thickness of the applied layer, the type of photoinitiator and the strength of the UV lamp. The curing time is preferably not longer than 10 minutes, in particular not longer than 5 minutes and particularly preferably shorter than 2 minutes. For continuous production of the security element according to the invention, short curing times of 3 minutes or shorter, preferably 1 minute or shorter and particularly preferably 30 seconds or shorter, are preferred.

The polymerisable mesogenic material may additionally also comprise one or more suitable components, such as, for example, catalysts, sensitisers, stabiusers, inhibitors, co-reacting monomers, surface-active substances, lubricants, wetting agents, dispersants, hydrophobicising agents, adhesives, flow improvers, antifoams, degassing agents, diluents, reactive thinners, assistants, dyes or pigments, for example also the flake-form effect pigments described above.

In order to prevent undesired spontaneous polymerisation of the polymerisable material, for example during storage, the addition of stabilisers is preferred. Stabilisers which can be employed here are all compounds which are known to the person skilled in the art for this purpose. A wide range of such compounds are commercially available. Typical examples of stabilisers are 4-ethoxyphenol and butylhydroxytoluene (BHT).

Other additives, for example chain-transfer reagents, may likewise be added in order to modify the physical properties of the resultant polymer film. If, for example, monofunctional thiol compounds, such as dodecanethiol, or multi-functional thiol compounds, such as, for example, trimethylolpropane tri-3-mercaptopropionate, are added as chain-transfer reagent, the length of the free polymer chains and/or the length of the polymer chains between two crosslinking sites can be controlled. If the amount of chain-transfer reagent is increased, the length of the polymer chains in the resultant polymer film decreases.

In order to increase the degree of crosslinking of the polymers, up to 20% by weight of non-mesogenic compounds containing two or more polymerisable functional groups may also be added alternatively or in addition to the di- or multi-functional polymerisable mesogenic compounds. Typical examples of difunctional non-mesogenic monomers are alkyl diacrylates or alkyl dimethacrylates containing alkyl groups having 1 to 20 C atoms. Typical examples of non-mesogenic monomers containing more than two polymerisable groups are trimethylolpropane trimethacrylate and pentaerythritol tetraacrylate.

In another embodiment, the polymerisable material comprises up to 70% by weight, preferably 3 to 50% by weight, of a non-mesogenic compound containing a polymerisable functional group. Typical representatives of mono-functional non-mesogenic monomers are alkyl acrylates and alkyl methacrylates.

In order to adjust the optical properties of the resultant polymeric film, it is also possible for up to 20% by weight of a non-polymerisable liquid-crystalline compound to be added.

The polymerisation is preferably carried out in the liquid-crystalline phase of the polymerisable material. For this reason, polymerisable mesogenic compounds or mixtures having low melting points and a broad liquid-crystal phase are preferably used. The use of such materials enables the polymerisation temperature to be reduced, which simplifies the polymerisation process and is particularly advantageous for continuous production. The choice of a suitable polymerisation temperature depends substantially on the clearing point of the polymerisable material and on the softening point of the substrate. The polymerisation temperature is preferably at least 30 degrees below the clearing point of the polymerisable mesogenic material. Polymerication temperatures below 120° C. are preferred, in particular temperatures below 90° C. and particularly preferably polymerisation temperatures of 60° C. or below.

The part-areas of the coating of the security element according to the invention are in the form of a dried or otherwise cured coating composition.

If the coating composition comprises inorganic flake-form effect pigments, it can be in the form of a dried and optionally cured coating comprising an organic binder (polymeric film) or in the form of a polymeric film comprising the effect pigments on the substrate.

If the coating composition comprises in-situ polymerised or crosslinked mesogenic compounds, it is likewise, depending on the layer thickness of the coating, in the form of a polymeric film or polymeric foil on the substrate. Since this layer, as already mentioned above, may also be located on an auxiliary substrate, for example a hot-embossing film, it does not have to be located directly on the substrate of the security element, but instead may be connected thereto, for example via an adhesive layer.

In a preferred embodiment of the present invention, at least one of the part-areas of the coating also has a further security feature. The further detectable security features are security features which can be detected optically, by machine or haptically.

Further optically detectable security features are those which are visible without aids or with only minor aids, but are different from the optical, in particular optically variable, colour and/or brightness impression of the security element according to the invention. However, it is not excluded that optically detectable security features of this type can likewise be evaluated by machine and thus detected by machine. They are additional visible information, such as printed characters, symbols or microtexts, but the additional optically detectable security feature is in particular a laser marking. The latter can be obtained in that the coating of at least one part-area comprises a material which is suitable for laser marking and is written using a laser beam. Laser-sensitive materials which make the coating laser-writable are, for example, various fillers, inorganic pigments, including electroconductive pigments and/or effect pigments, such as, for example, interference pigments or pearlescent pigments, as already described above. These can thus both provide the coatings of the part-areas of the security element according to the invention with a characteristic coloration and also make the area laser-markable.

Fillers and inorganic pigments which have proven particularly suitable are particulate $SiO_2$ and $TiO_2$ as well as phyllosilicates, such as muscovite mica or other micas, such as phlogopite and biotite, synthetic mica, talc flakes and glass flakes. Suitable effect pigments have already been described in detail above. Suitable electroconductive pigments are described below. Further suitable laser-sensitive pigments are the oxides, hydroxides, sulfides, sulfates and phosphates of metals, such as, for example, copper, bismuth, tin, zinc, silver, antimony, manganese, iron, nickel or chromium, which are often inorganic coloured pigments.

In order to produce the laser marking, the security elements on the laser-sensitive coating are marked using high-energy radiation in the wavelength range from 157 to 10,600 nm, in particular in the range from 300 to 10,600 nm. For example, the $CO_2$ lasers (10,600 nm), Nd:YAG lasers (1064 or 532 nm) or pulsed UV lasers (excimer lasers) known from the prior art can be employed here. Particular preference is given to the use of Nd:YAG lasers and $CO_2$ lasers. The energy densities of the lasers employed are generally in the range from 0.3 $mJ/cm^2$ to 50 $mJ/cm^2$, preferably in the range from 0.3 $mJ/cm^2$ to 10 $mJ/cm^2$.

Suitable machine-detectable security features are those whose luminescent, magnetic, electroconductive, thermoelectric or piezoelectric properties can be established by means of conventional technologies and instruments. To this end, the coating of at least one part-area of the security element according to the invention additionally comprises at least one material having luminescent, magnetic, electroconductive, thermoelectric or piezoelectric properties, which may be particulate.

These materials may be present individually or in a combination of two or more in the coating of one or more part-areas of the security element according to the invention.

Luminescent compounds are taken to mean substances which emit machinemeasurable and optionally visible radiation through excitation in the visible wavelength region, in the IR or UV wavelength region of light, through electron beams or through X-rays. These also include substances which emit radiation through excitation in an electromagnetic field, so-called electroluminescent substances, which optionally additionally luminesce through excitation in the UV or IR wavelength region. Neither the incident nor the emitted light has to be visible here. Preference is given to fluorescent or phosphorescent substances at the incidence of UV light (ultraviolet light) and to so-called upconverters, which emit visible radiation on incidence of IR light (infrared light). Suitable for this purpose are all known particulate and soluble substances having the above-mentioned properties which can be introduced into the said coatings without significantly impairing the optical effect of the flake-form effect pigments or the in-situ polymerised or crosslinked mesogenic materials. The particulate substances here have a suitable particle size, i.e. having an average particle size of about 0.001 to about 35 μm, preferably 0.005 to 20 μm and particularly preferably 0.01 to 1 μm.

These particulate substances do not necessarily have to be in pure form, but instead may likewise comprise microencapsulated particles and support materials impregnated, doped or coated with luminescent substances.

Besides organic luminescent substances of any type, examples of luminescent substances which may be mentioned here are the following compounds: Ag-doped zinc sulfide ZnS:Ag, zinc silicate, SiC, ZnS, ZnS, CdS, which have been activated with Cu or Mn, ZnS/CdS:Ag; ZnS:Cu, Al; $Y_2O_2S$:Eu; $Y_2O_3$:Eu; $YVO_4$:Eu; $Zn_2SiO_4$:Mn; $CaWO_4$; $(Zn,Mg)F_2$:Mn; $MgSiO_3$:Mn; ZnO:Zn; $Gd_2O_2S$:Tb; $Y_2O_2S$:Tb; $La_2O_2S$:Tb; BaFCl:Eu; LaOBr:Tb; Mg tungstate; (Zn, Be) silicate: Mn; Cd borate:Mn; $[Ca_{10}(PO_4)_6F$, Cl:Sb, Mn]; $(SrMg)_2P_2O_7$:Eu; $Sr_2P_2O_7$:Sn; $Sr_4Al_{14}O_{25}$:Eu; $Y_2SiO_5$:Ce, Tb; $Y(P,V)O_4$:Eu; $BaMg_2Al_{10}O_{27}$:Eu or $MgAl_{11}O_{19}$:Ce,Tb.

In order to produce electroluminescent properties, at least one of the part-areas of the security element according to the invention additionally comprises at least one particulate substance having electroluminescent properties and preferably likewise a transparent electroconductive pigment.

The substances having electroluminescent properties are generally particulate materials which comprise inorganic compounds from group II and VI of the Periodic Table, for example ZnS or CdS, which have been doped or activated with metals, such as Cu, Mn or Ag. Particulate luminescent substances based on silicates, aluminates, phosphates, tungstates, germanates, borates, etc., activated predominantly with Mn, Sr or with rare earths, in particular substances based on $Zn_2SiO_4$:Mn, or also particulate organic polymers, or mixtures of the above-mentioned compounds, can likewise be employed.

These substances emit visible radiation after excitation in an electric alternating field. The emission of visible light preferably takes place alone or predominantly through the excitation in an electric alternating field and to a lesser extent also through excitation in the ultraviolet or infrared spectral region.

The particles are advantageously in the form of microencapsulated compounds. Suitable materials for the sheathing layer are, in particular, polymers or also various metal oxides. These protect the electroluminescent substances against various ambient influences, for example against the wet components of a printing ink, which, on long-term exposure, may cause decomposition of the electroluminescent substances. In addition, the ageing resistance of the electroluminescent substances can be increased or their light emission modified by filter layers.

The particle size of the particles is selected so that it is suitable for the coating type selected. Since it is also intended to use printing processes, in particular also gravure printing processes, the average particle sizes are preferably in the range from about 0.2 to about 100 μm, preferably 1 to 50 μm and particularly preferably 2 to 30 μm.

In order to ensure, when required, that no excitation of the luminescence in the ultraviolet spectral region takes place, UV filter layers may additionally be applied to the surface of the electroluminescent particles.

It is also possible to add inorganic or organic dyes to the particulate electroluminescent substances, so that the reflection bands or absorption bands of these substances shift. It is thus possible significantly to extend the range of hues available for light emission since the originally usable base materials only emit a small number of hues. In addition, electroluminescence in different colours can be achieved in this way in different part-areas of the security element according to the invention using the same electroluminescent material.

The particulate electroluminescent substances can be employed individually or in a mixture of two or more different substances. If different substances are employed, it is advantageous for them to emit radiation of different colour.

Substances having electroconductive properties are generally in particulate form and consist of or comprise electroconductive substances.

Preference is given to the use of pigments which have at least one electroconductive layer. For many areas of application, in particular in the case of a combination of electroconductive pigments with other additives in order to produce additional security features, it is advantageous to employ transparent electroconductive pigments.

The transparent electroconductive pigments employed are pigments which have at least one transparent electroconductive layer. Preference is given to the use of pigments which have at least one transparent electroconductive layer on a substrate which is selected from the group consisting of $TiO_2$, synthetic or natural mica, other phyllosilicates, glass, $SiO_2$ and/or $Al_2O_3$.

It is particularly preferred here for the said substrates to be in flake form. In principle, however, the use of pigments which have at least one transparent electroconductive layer on a non-flake-form substrate comprising the above-mentioned materials is also suitable. Transparent pigments which consist of an electroconductive material are likewise suitable. It is particularly advantageous for the electroconductive pigments to have gently rounded-off shapes without corners, sharp edges or projecting points both in cross section and also in the longitudinal axis. The use of non-flake-form pigments is restricted merely through the applicational properties in the security element according to the invention.

In general, the electroconductive layer or the electroconductive material of the transparent electroconductive pigments comprises one or more conductive doped metal oxides, such as, for example, tin oxide, zinc oxide, indium oxide or titanium oxide, which have been doped with gallium, aluminium, indium, thallium, germanium, tin, phosphorus, arsenic, antimony, selenium, tellurium and/or fluorine.

The above-mentioned transparent conductive pigments may, if a substrate is present, have one or more further layers above and/or below the conductive layer. These layers may comprise metal oxides, metal oxide hydrates, metal suboxides, metal fluorides, metal nitrides, metal oxynitrides or mixtures of these materials.

The colour properties of the pigments can be matched to the users' requirements through the application of these additional layers, in particular if the additional layers are located below the conductive layer. The application of additional layers above the conductive layer enables the conductivity to be matched specifically to the use requirements.

It has been observed that it is, for example, quite advantageous for a dielectric layer, which prevents direct contact of the conductive layers in the case of mutual contact of conductive pigments in the security element according to the invention, to be located above the conductive layer.

A particularly preferred material for a transparent electroconductive pigment is a mica coated with at least one electroconductive metal oxide layer. Particular preference is given here to a mica pigment which is coated with a layer of antimony-doped tin oxide, a mica pigment which is coated with a titanium oxide layer, a silicon oxide layer and with an antimony-doped tin oxide layer, or a mica pigment which is coated with an antimony-doped tin oxide layer and a further metal oxide layer, in particular a titanium oxide layer.

Pigments of this type are commercially available and are offered, for exampie, by Merck KGaA. However, electroconductive particulate materials from other manufacturers are also suitable, in particular also the graphite or carbon-black particles usually used for such purposes, if transparent electroconductive materials are not necessary. The electroconductive particulate materials generally have average particle sizes of 0.001 to about 35 μm, preferably 0.005 to 20 μm and particularly preferably 0.10 to 10 μm. A narrow particle-size distribution is preferred here.

If it is intended for electroluminescent properties to be present in the security element according to the invention, the electroconductive pigment preferably employed for this purpose in addition to the electroluminescent material should preferably have sufficiently high transparency at the same time as high electrical conductivity. For this reason, it is necessary for the particle diameter of the pigment to be in a range from 1 to 500 μm, preferably from 2 to 100 μm and particularly preferably from 5 to 70 μm. A narrow particle-size distribution is preferred.

The aspect ratio, i.e. the ratio of diameter to thickness of the pigments, in the case of flake-form conductive pigments is at least 2:1, but preferably at least 10:1 and particularly preferably at least 100:1.

Electroconductive flake-form pigments of the composition described above whose number-weighted average particle area $F_{50}$ is greater than or equal to 150 $\mu m^2$, in particular greater than or equal to 200 $\mu m^2$, have proven to be particularly transparent with high conductivity. They have even more advantageous properties if the number-weighted proportion of pigments having a particle area of less than 80 $\mu m^2$ is less than or equal to 33% and preferably less than 25%, based on the transparent conductive pigments. However, even better transparency is obtained if the number-weighted proportion of pigments having a particle area of less than 40 $\mu m^2$ is less than or equal to 15% and preferably less than or equal to 10%, based on the transparent conductive pigments. The reduction in the fines proportions results in a reduction in light scattering and thus in the haze in the security element according to the invention.

Particle area is taken to mean the value for the size of the main area of the flakes, namely the area having the longest axis.

The fines proportion is monitored, for example, by measuring under the microscope and counting the measured particles. This can be carried out visually, optionally simplified by comparison of the samples against counted standards, or automatically with the aid of a video camera and suitable automatic image evaluation software. Automatic evaluation systems of this type for particle size analysis are known to the person skilled in the art and are commercially available. For a statistically significant particle size analysis, at least 1000 and preferably 2000 particles or more should be measured.

In a security element according to the invention, the transparent electroconductive pigment can be employed individually or in the form of a mixture of two or more different pigments. The difference here can consist both in the use of pigments comprising different materials, having different shapes and/or different colours. Only the optical transparency of the material should be ensured.

In order to achieve good machine readability with sufficiently high electroluminescent intensity, it is essential that the security element of the present invention comprises both substances having electroluminescent properties and also preferably transparent electroconductive pigments, since the presence of the latter causes an increase in the electroluminescent intensity of the former and thus generates machine readability.

Substances having magnetic properties are also generally in particulate form. In principle, all particles which consist of magnetisable materials or comprise magnetisable materials as core, coating or doping are suitable for this purpose. Magnetisable materials which can be employed here are all known materials, such as magnetisable metals, magnetisable metal alloys or metal oxides and oxide hydrates, such as, for example, $\gamma$-$Fe_2O_3$ or FeOOH. Their average particle size is generally in the range from about 0.01 to about 35 μm, preferably 0.03 to 30 μm and particularly preferably 0.04 to 20 μm. The magnetic properties of the particles should of course be sufficiently strong that they can be determined by machine. Their shape is not crucial, in particular needle-shaped magnetic particles can also be employed.

The pigments already mentioned above which have at least one layer comprising metallic iron on a transparent flake-form support can also particularly advantageously be employed here as substances having magnetic properties. In the most favourable case, these pigments are also optically variable, i.e. change their colour with changing illumination and/or viewing angle, owing to the further layers also present and the layer thicknesses matched to one another. In this way, the coating of the at least one part-area of the security element according to the invention can be designed to be optically variable and also magnetisable through the addition of a single pigment, which is of particular importance for the security aspect of the feature. The size ratios of these pigments and also of other flake-form magnetisable pigments are generally in the ranges as have already been described above for the support materials of the flake-form effect pigments.

Machine-readable materials which can be incorporated into the coating of the part-areas of the security element according to the invention are also thermoelectric and piezoelectric materials. The thermoelectric materials employed here are substances having high electrical, but low thermal conductivity, for example nanostructures comprising heavy elements, such as caesium bismuth tellurides, lead tellurides, lead tellurium selenides, bismuth tellurides, antimony tellurides, etc. The piezoelectric material employed is preferably quartz particles which produce an electric voltage on deformation or cause a deformation on application of an electric voltage. These materials have average particle sizes of about 0.001 to about 35 μm.

The machine-readable constituents mentioned here may be present individually or in a mixture with one another in the part-areas of the security element in accordance with the present invention.

In this case, it appears advantageous to provide the security element with a coding which enables identification of encoded information, for example on the manufacturer, the product composition and the like, through a suitable combination of identical or different machine-readable constituents. Such forms of coding are already known per se and encompass, for example, variously coloured luminescent particles in a defined ratio to one another which can unambiguously label a certain product or even a certain batch of a product.

Due to the different types of machine-readable constituents and their ability to be found using different detection equipment, but also due to the large number of different substances within one type, a virtually infinite number of potential variations thus arise for assigning to a certain security element precisely one certain coding which can only be detected by machine and thus has high counterfeiting security.

The concentration of the machine-readable constituents in the coating of the security element is determined substantially by the degree of their detectability by machine. In general, the machine-readable constituents are present in the coating in an amount of 0.01 to 12% by weight, preferably in an amount of 0.05 to 10% by weight and particularly preferably 0.1 to less than 5% by weight, in each case based on the total weight of the coating.

In a particularly preferred embodiment of the present invention, the security element, besides the optically variable colouring of at least one of the part-areas, has a machine-detectable constituent in one or more of the part-areas and may in addition also be provided with a further visible security feature, for example a microtext, printed characters or symbols or a laser marking. This enables security elements to be obtained which are optically variable and in addition may comprise both a further optically detectable security feature and also a machine-detectable security feature.

This gives rise to the possibility of providing the security element according to the invention simultaneously with two different security classes, namely one overt and one covert.

In addition to optically variable colouring of at least one of the part-areas and the colour comparison of the part-areas with one another at different illumination and/or viewing angles, the additional optically detectable constituent results in a further visible effect which can be detected reliably by an unpractised viewer without further aids. By contrast, the machine-detectable constituent(s) give(s) rise to a further security class which can only be detected by an expert assessor with the aid of special equipment. This combination significantly increases the counterfeiting security of security elements.

Haptically detectable security features are those which can be detected via the human sense of touch. This does not exclude them from also being detectable by machine by means of suitable equipment. Haptically detectable security features are obtainable via the incorporation of suitable materials into the coating, via unequal layer thicknesses of the coating or via a subsequent mechanical treatment of the coating, for example with application of temperature and pressure (embossing). In this way, high/low structures can be obtained in the coating.

In particular if the coating is in the form of a polymeric film, it can be provided with a high/low structure by processes such as pressing, embossing, stamping and other similar processes. So long as the high/low structure is only present at the surface of the polymeric layer, any optically variable colour impression of the polymeric film, for example, is also not completely lost. For this purpose, the surface of the coating, which is in the form of a polymeric film, is warmed partly or over the entire area until a certain flowability of the upper layer is achieved (partial melt). To this end, temperatures of about 50° C. to about 220° C. are generally sufficient. Through the use of suitable shaping tools, the polymeric film is provided with a high/low structure at pressures of about 100 bar to about 600 bar and subsequently allowed to cool. During the cooling, the high/low structure previously produced manifests itself.

The person skilled in the art is entirely capable here of making a suitable choice from the processes and process conditions which are generally customary. The polymeric films described above can also be provided with high/low structures with the aid of suitable tools.

Such coatings, which, besides any optically variable colouring present, also have a high/low structure, can thus be used without problems for the production of security elements according to the invention which are optically variable and at the same time have a haptically detectable security feature, since embossings can generally be detected via the human sense of touch, irrespective of their shape and depth. This does not exclude these high/low structures from also being machine-detectable.

It goes without saying that the coating in the form of a polymeric film or polymeric foil is for practical reasons usually only provided with a high/low structure when the security element according to the invention is already in place in or on a product to be protected, in order, for example, to prevent the high/low structure from being damaged on incorporation of the security element into the product to be protected. If suitable protective measures are taken, however, the high/low structure may also be applied to the coating in advance if the coating is only later transferred to the part-area of the security element.

Besides the said substances which are suitable as additional security features, the coating for the security element according to the invention may also comprise further inorganic or organic colorants, i.e. coloured pigments or soluble dyes, on one or more of the part-areas. These colorants can serve for the desired fine tuning of the colour properties of the part-areas.

Suitable inorganic colorants are, for example, all common transparent and opaque white, coloured and black pigments, such as, for example, Berlin Blue, bismuth vanadate, goethite, magnetite, haematite, chromium oxide, chromium hydroxide, cobalt aluminate, ultramarine, chromium/iron mixed oxides, spinels, such as Thenards Blue, cadmium sulfides and selenides, chromate pigments or carbon black, while organic colorants which may be mentioned are, in particular, quinacridones, benzimidazoles, copper phthalocyanine, azo pigments, perinones, anthanthrones, further phthalocyanines, anthraquinones, indigo, thioindigo and derivatives thereof, or Carmine Red.

In general, it is possible to employ all organic or inorganic colorants, in particular those which are common in the printing sector.

For screening against ultraviolet radiation, it is also possible to employ pigments which absorb UV light. Of these, mention may be made, merely by way of example, of titanium dioxide and zinc oxide.

The particle size of the inorganic and organic coloured pigments is not limited, but must be matched to the requirements of the application of the coating of the security element, for example if this is carried out by means of a printing process. The corresponding peculiarities with respect to the size of the particles must also be observed on introduction into polymeric films.

The present invention also relates to a process for the production of a security element in which at least two different coating compositions are applied to at least one surface of a substrate in such a way that a coating is formed from at least two adjacent part-areas which can be distinguished from one another, where the coating compositions comprise inorganic flake-form effect pigments or in-situ polymerisable and/or crosslinkable mesogenic materials, which are selected so that at least one of the part-areas of the coating has different colours depending on the illumination and/or viewing angle, and the colours of at least two of the part-areas are different from one another under any illumination and/or viewing angle, and the coating is optionally solidified.

In a preferred embodiment of the invention, two coating compositions each comprise inorganic flake-form effect pigments or polymerisable and/or cross-linkable mesogenic materials which are different from one another and have different colour and/or brightness impressions depending on the illumination and/or viewing angle, and two or more part-areas of the coating are applied therewith, where the colours of at least two of the part-areas are different from one another under any illumination and/or viewing angle. This means that at least two of the part-areas have an optically variable behaviour and have different colours under any illumination and/or viewing angle.

In a further preferred embodiment of the invention, three or more coating compositions each comprise flake-form effect pigments or polymerisable and/or crosslinkable mesogenic materials which are different from one another and have different colour and/or brightness impressions depending on the illumination and/or viewing angle, and three or more part-areas of the coating are applied therewith, where the colours of three or more of the part-areas are different from one another under any illumination and/or viewing angle. This embodiment thus allows the design of a security element according to the invention in such a way that at least three differently coloured part-areas can be detected simultaneously under any possible illumination and/or viewing angle.

At least two directly adjacent part-areas whose colours are different from one another under any illumination and/or viewing angle are preferably applied. Strong colour contrasts and impressive colour plays under various angles are thus particularly readily visible, even on relatively small area units.

The coating compositions are preferably applied to the surface of the substrate in the form of a paint, a printing ink, an in-situ polymerisable and/or crosslinkable mesogenic composition or a polymeric film.

Printing inks are usually applied to the surface of the substrate by means of standard printing processes.

Besides the said inorganic flake-form effect pigments and optionally one or more of the other particulate materials mentioned, printing inks may also comprise conventional further additives. These generally consist of one or more suitable organic binders, which are optionally supplemented by solvents, adhesion promoters, dispersion aids, drying accelerators, photoinitiators and the like which are generally customary in printing inks. It goes without saying here that the binders and additives are matched to the printing process used and that the printing ink has an appropriate viscosity.

Suitable printing processes are in principle all printing processes which are known and customary in the production of security products, such as, for example, offset printing, letterset printing, offset coating, flexographic printing, screen printing, thermosublimation printing, gravure printing, in particular photogravure printing and intaglio printing, the so-called overprint varnish process, and all non-contact printing processes. Screen printing is particularly preferably used.

Other suitable application methods with which paints are commonly applied are, for example, knife coating, brushing, stamping, curtain coating methods, lacquering methods, flow coating methods, roller or raster application methods or application by means of air brushes. Paints here, depending on the method used, comprise similar additives to printing inks.

The coating of the part-areas of the security element according to the invention can also be carried out in the form of a polymeric film. This can be, for example, a film laminated or adhesively bonded to the surface of the substrate or a film coextruded in advance with other polymer films. Also suitable are rigid plates made from polymeric materials which are bonded to the surface or to other, optionally information-carrying layers in a conventional manner, for example by adhesive bonding.

The thickness of the polymeric film or polymeric foil, the polymeric material, the flexibility of the layer or the type of bonding of this layer to the surface of the security element or other layers lying in between is not limiting so long as at least the colour of the layer (where appropriate the angle-dependent colour play) and any further security features that may be present in this layer can be unambiguously detected and evaluated.

The polymeric film or polymeric foil, which comprises inorganic flake-form effect pigments, is, however, preferably transparent. Transparent polymers are therefore preferably employed. This applies, for example, to polycarbonate, polystyrene, polyvinyl chloride and copolymers and graft polymers thereof, polyvinylidene chloride and fluoride, polyamides, polyolefins, polyacrylates and polyvinyl esters, thermoplastic polyurethanes, cellulose esters and the like. They can be employed individually or in suitable mixtures.

In addition, the polymeric layer may additionally comprise customary assistants and additives, such as fillers, UV stabilisers, inhibitors, flameproofing agents, lubricants, plasticisers, solvents, dispersants and additional dyes or organic and/or inorganic coloured pigments.

The polymeric films are preferably produced by various suitable processes, such as film casting, spin coating, extrusion processes, calendaring or pressing processes, but in particular by extrusion processes or via a film blowing process. To this end, the various starting materials are mixed with one another and converted into polymer layers in the form of films of various thickness or thin sheets in suitable, generally known equipment. The flake-form effect pigments present in the polymer material and any further flake-form pigments still present are aligned at the surfaces of the moulds and are therefore aligned essentially parallel to the surfaces of the polymeric layer in the polymeric layers formed. Stretching and tensioning operations during film blowing or as working steps after extrusion additionally reinforce this alignmeat of the pigments. On subsequent cooling, this alignment is fixed.

However, the coating in the form of a polymeric film or polymeric foil may also consist to a significant proportion of in-situ polymerised and/or crosslinked mesogenic materials. In this case, the coating composition which comprises in-situ polymerisable and/or crosslinkable mesogenic materials and optionally further assistants and additives is applied with a suitable viscosity to the surface of the substrate, where it is solidified by drying and/or crosslinking/polymerisation.

Suitable ingredients for the coating composition have already been described above.

Suitable application methods are the various known printing processes and application methods already described above, but in addition also printing processes which are not particularly suitable for coating compositions comprising coarse particles, such as intaglio printing or ink-jet printing.

Depending on the materials used in the coating composition for the production of the colour properties or angle-dependent colour-change properties, the substrate on the surface which is provided with the coating has entirely or partly a black, grey or other dark colour or is formed entirely or partly in a reflective manner below the coating, or is provided entirely or partly with a black, grey or other dark-coloured layer or a reflective coating before it is coated with the coating composition. It is of course likewise possible for the surface of the substrate below the coating, depending on the ingredients selected in the coating, to be formed partly in a black, grey or dark colour and partly in a reflective manner.

Details in this respect have already been described above.

At least one of the part-areas of the coating of the security element according to the invention preferably has a defined shape. This can be a symbol, a stripe, a geometrical shape, a design, lettering, an alphanumeric character, the representation of an object or parts thereof. The shape of these part-areas is basically not restricted other than by the technical possibilities of the coating types used.

In a particularly preferred embodiment of the invention, at least one of the part-areas has a defined shape and at least one further part-area forms a background for the shape. The background area may itself likewise have its own shape which is different from the first shape or is identical to the first shape and differs from the first shape merely in size. For clarification, mention may be made here, for example, of a letter or lettering or number on a rectangular, square or round area surrounding it, where both part-areas are equipped in accordance with Claim 1.

The optically variable security element in accordance with the present invention is preferably in the form of a label, sticker, transfer element, security strip, print, film, window or comparable designs. In accordance with its shape or construction, it may cover all or some of the surface of an object to be protected or be incorporated into such an object.

The security element according to the invention is preferably used to protect articles against counterfeiting, even when it is entirely possible, owing to its colour design, for it likewise to be incorporated into the artistic design of the corresponding article and thus also to meet design requirements.

Suitable articles to be protected are conventional security articles from the high-security sector and the moderate security sector, such as banknotes, cheques, credit cards, shares, passports, identity documents, driving licences, postage stamps, seals and labels, but also packaging materials or articles of daily use, such as, for example, clothing, shoes, domestic articles, or packaging for perfumes, pharmaceuticals, cigarettes or delicatessen products. However, this list is illustrative and should not be regarded as limiting. The applicability of the security element according to the invention is basically limited only by economic considerations.

In the security element according to the invention, a means is available for protecting articles against counterfeiting which ensures good visual detectability at various illumination and/or viewing angles, even for the unpractised user, can be employed on small area units, optionally allows additional integration of various further security features and can therefore be employed very variably in various security classes, at the same time can be produced inexpensively by a very simple process, preferably a conventional printing process, and is difficult to counterfeit. Furthermore, the security element according to the invention can be used on virtually all articles which are to be protected against counterfeiting and can also be provided with a visually attractive design. This enables a very flexible reaction to different requirements of product protection.

However, it goes without saying that the security element according to the invention can be used on the article to be protected together with further security features known from the prior art.

The invention will be explained below with reference to examples which describe the invention, but are not intended to restrict it.

EXAMPLE 1 a)

10 g of a flake-form security pigment having a colour flop of the interference colour from red to gold (multilayered pigment based on mica; colour scheme of the resultant coating, steep viewing angle/flat viewing angle) from Merck KGaA, Darmstadt, are mixed with 90 g of screen-printing binder MZ-Lack 093 (Pröll, Weissenburg), the mixture is homogenised and adjusted to printing viscosity using the solvent mixture Thinner ZC 521 (Sericol AG, Dagmersellen, CH).

b)

10 g of a flake-form security pigment having a colour flop from gold to red (multilayered pigment on transparent dielectric support material; colour scheme of the resultant coating, steep viewing angle/flat viewing angle) from Merck KGaA, Darmstadt, are mixed with 90 g of screen-printing binder MZ-Lack 093 (Pröll, Weissenburg), the mixture is homogenised and adjusted to printing viscosity using the solvent mixture Thinner ZC 521 (Sericol AG, Dagmersellen, CH).

The screen-printing ink obtained in Example 1a is printed onto vellum paper by means of a rectangular stencil and a screen of size 77T on a hand screen-printing machine (model ATMA; ESC, Bad Salzuflen) and left to dry. The screen-printing ink obtained in Example 1b is subsequently likewise printed onto the vellum paper via a rectangular stencil adjacent to the first print with the same hand screen-printing machine and left to dry.

A security element comprising two rectangular part-areas directly adjacent to one another which exhibits a red colour on one part-area (1a) and a golden colour on the adjacent part-area (1b) when viewed virtually perpendicularly (steep viewing angle) at the gloss angle. If the printed paper is tilted slowly towards a flat viewing angle, this colour scheme is initially retained until a sudden colour change takes place in such a way that a golden colour is perceptible on the first part-area (1a) and a red colour is perceptible on the second part-area (1b).

EXAMPLE 2 a)

10 g of a flake-form security pigment having a colour flop of the interference colour from red to gold (multilayered pigment based on mica; colour scheme of the resultant coating, steep viewing angle/flat viewing angle) from Merck KGaA, Darmstadt, and 1 g of a green-fluorescent pigment are mixed with 89 g of screen-printing binder MZ-Lack 093 (Pröll, Weissenburg), the mixture is homogenised and adjusted to printing viscosity using the solvent mixture Thinner ZC 521 (Sericol AG, Dagmersellen, CH).

b)

10 g of a flake-form security pigment having a colour flop from gold to red (multilayered pigment on transparent dielectric support material; colour scheme of the resultant coating, steep viewing angle/flat viewing angle) from Merck KGaA, Darmstadt, and 1 g of a red-fluorescent pigment are mixed with 89 g of screen-printing binder MZ-Lack 093 (Pröll, Weissenburg), the mixture is homogenised and adjusted to printing viscosity using the solvent mixture Thinner ZC 521 (Sericol AG, Dagmersellen, CH).

The screen-printing ink obtained in Example 2a is printed onto vellum paper by means of a round stencil and a screen of size 77T on a hand screen-printing machine (model ATMA; ESC, Bad Salzuflen) and left to dry. The screen-printing ink obtained in Example 2b is subsequently printed onto the paper via a ring-shaped stencil which has a central cut-out in the size of the round stencil, so that the first print (2a) is surrounded in a ring-shaped manner by the second print (2b).

Drying gives a round security element which has a central part-area (2a) which exhibits a red colour when viewed virtually perpendicularly at the gloss angle (steep viewing angle) and a golden colour on the part-area (2b), which is adjacent in a ring-shaped manner. If the printed paper is tilted slowly towards a flat viewing angle, this colour scheme is initially retained until a sudden colour change takes place in such a way that a golden colour is perceptible on the first part-area (2a) and a red colour is perceptible on the second part-area (2b).

Under UV light, the inner round part-area exhibits green fluorescence, while red fluorescence is visible on the outer ring-shaped part-area.

EXAMPLE 3 a)

10 g of a security pigment having a colour flop of the interference colour from green to violet (multilayered pigment based on $SiO_2$ flakes; colour scheme of the resultant coating, steep viewing angle/flat viewing angle) from Merck KGaA, Darmstadt, 5 g of a black pigment based on flake-form mica (product from Merck KGaA, Darmstadt) and 1 g of a green-fluorescent pigment are mixed with 84 g of screen-printing binder MZ-Lack 093 (Pröll, Weissenburg), the mixture is homogenised and adjusted to printing viscosity using the solvent mixture Thinner 521 (Sericol AG, Dagmersellen, CH).

b)

10 g of a flake-form security pigment having a colour flop from violet to green (multilayered pigment on transparent dielectric support material; colour scheme of the resultant coating, steep viewing angle/flat viewing angle) from Merck KGaA, Darmstadt, 5 g of a black pigment based on flake-form mica (product from Merck KGaA, Darmstadt) and 1 g of a red-fluorescent pigment are mixed with 84 g of screen-printing binder MZ-Lack 093 (Pröll, Weissenburg), the mixture is homogenised and adjusted to printing viscosity using the solvent mixture Thinner 521 (Sericol AG, Dagmersellen, CH).

The screen-printing inks obtained in Examples 3a and 3b are printed onto vellum paper via stencils in accordance with Example 2 and left to dry. A round security element is obtained which has a central part-area (3a) which exhibits a green colour when viewed virtually perpendicularly at the gloss angle (steep viewing angle) and a violet colour on the part-area (3b) which is adjacent in a ring-shaped manner. If the printed paper is tilted slowly towards a flat viewing angle, the said colour scheme is initially retained until a sudden colour change takes place in such a way that a violet colour is perceptible on the first part-area (3a) and a green colour is perceptible on the second part-area (3b).

Under UV light, the inner round part-area exhibits green fluorescence, while red fluorescence can be perceived on the outer ring-shaped part-area.

The invention claimed is:

1. Optically variable security element comprising a substrate which has on at least one surface a coating which comprises at least two coloured part-areas adjacent to one another which can be distinguished from one another and can be detected simultaneously by the eye, where the at least two coloured part-areas comprise inorganic flake-form effect pigments or in-situ polymerised and/or crosslinked mesogenic materials, and at least one of the at least two coloured part-areas has different optically distinguishable discrete colours depending on the illumination and/or viewing angle, and the colours of the at least two of the part-areas are optically distinctly different from one another under any illumination and/or viewing angle and these at least two of the part-areas exhibit different hues under any illumination and/or viewing angle.

2. Optically variable security element according to claim 1, characterised in that at least two part-areas of the coating have different colours under different illumination and/or viewing angles.

3. Optically variable security element according to claim 1, characterised in that all part-areas of the coating have different colours under different illumination and/or viewing angles.

4. Optically variable security element according to claim 1, characterised in that every two adjacent part-areas of the coating have different colours under different illumination and/or viewing angles.

5. Optically variable security element according to claim 1, characterised in that two part-areas of the coating are selected in such a way that, under a first illumination and/or viewing angle, the first part-area, has a first colour and the second part-area has a second colour, and, under a second illumination and/or viewing angle which is different therefrom, the first part-area has the said second colour and the second part-area has the said first colour.

6. Optically variable security element according to claim 1, characterised in that two part-areas of the coating are selected in such a way that, under a first illumination and/or viewing angle, the first part-area has a colour which corresponds to the complementary colour of the second part-area, and, under a second illumination and/or viewing angle which is different therefrom, the first and second part-areas each have a colour which corresponds to the complementary colour of the colour that these areas each have under the first viewing angle.

7. Optically variable security element according to claim 5, characterised in that the first and second part-areas are directly adjacent to one another.

8. Optically variable security element according to claim 1, characterised in that the substrate on the surface which is provided with the coating has entirely or partly a black, grey or other dark hue colour which has a strongly absorbent action below the coating.

9. Optically variable security element according to claim 1, characterised in that the substrate on the surface which is provided with the coating is formed entirely or partly in a reflective manner below the coating.

10. Optically variable security element according to claim 1, characterised in that at least one of the part-areas of the coating has a defined shape.

11. Optically variable security element according to claim 10, characterised in that the shape is a symbol, a stripe, a geometrical shape, a design, lettering, an alphanumeric character, the representation of an object or parts thereof.

12. Optically variable security element according to claim 10, characterised in that at least one of the part-areas has a defined shape and at least one further part-area forms a background for the shape.

13. Optically variable security element according to claim 1, characterised in that the substrate is transparent, semitransparent or opaque.

14. Optically variable security element according to claim 13, characterised in that the substrate is a paper, a polymeric material, a textile material, a metallic material, wood or a composite material comprising at least two identical or different types of these materials.

15. Optically variable security element according to claim 1, characterised in that the flake-form effect pigment is a pearlescent pigment, a transparent or semitransparent interference pigment, a metal-effect pigment or a mixture of two or more of these pigments.

16. Optically variable security element according to claim 1, characterised in that the flake-form effect pigment comprises an inorganic flake-form support with at least one coating comprising a metal, metal oxide, metal oxide hydrate or mixtures thereof, a metal mixed oxide, suboxide, oxynitride, metal fluoride, BiOCl or a polymer.

17. Optically variable security element according to claim 1, characterised in that the flake-form effect pigment has different colours and/or brightness values depending on the illumination and/or viewing angle.

18. Optically variable security element according to claim 1, characterised in that the flake-form effect pigment has different interference colours depending on the illumination and/or viewing angle.

19. Optically variable security element according to claim 16, characterised in that the flake-form support is natural or synthetic mica, kaolin, talc, another phyllosilicate, $SiO_2$, glass, a borosilicate, graphite, $Al_2O_3$ or a metal.

20. Optically variable security element according to claim 1, characterised in that the in-situ polymerised and/or crosslinked mesogenic material is a cholesterie, smectic or nematic material which is polymerised and/or crosslinked on the substrate or an auxiliary substrate with formation of the coating.

21. Optically variable security element according to claim 1, characterised in that the in-situ polymerised and/or crosslinked mesogenic material comprises, before the polymerisation and/or crosslinking, at least one polymerisable mesogenic compound Which contains a polymerisable functional group and at least one polymerisable mesogenic compound which contains two or more polymerisable functional groups.

22. Optically variable security element according to claim 1, characterised in that the coating is in the form of a polymeric film or polymeric foil.

23. Optically variable security element according to claim 1, characterised in that at least one of the part-areas of the coating is additionally provided with a further security feature.

24. Optically variable security element according to claim 23, characterised in that the further security feature is a security feature which can be detected optically, by machine or haptically.

25. Optically variable security element according to claim 23, characterised in that the further security feature is a character, a symbol, a microtext, a laser marking, a luminescent, magnetic, electroconductive, thermoelectric or piezoelectric feature or a high/low structure.

26. Optically variable security element according to claim 25, characterised in that the further security feature is a luminescent security feature which is an electroluminescent feature or a feature in which a substance irradiated with infrared light luminesces in the visible wavelength region.

27. Optically variable security element according to claim 1, characterised in that it is in the form of a label, sticker, transfer element, security strip, print, window or in the form of a film.

28. Process for the production of a security element according to claim 1, in which at least two different coating compositions are applied to at least one surface of a substrate in such a way that a coating is formed from at least two adjacent part-areas which can be distinguished from one another, where the coating compositions comprise inorganic flake-form effect pigments or in-situ polymerisable and/or crosslinkable mesogenic materials, which are selected so that at least one of the part-areas of the coating has different colours depending on the illumination and/or viewing angle, and the colours of at least two of the part-areas are different from one another under any illumination and/or viewing angle, and the coating is optionally solidified.

29. Process according to claim 28, characterised in that two coating compositions each comprise inorganic flake-form effect pigments or polymerisable and/or crosslinkable mesogenic materials which are different from one another and have different colour and/or brightness impressions depending on the illumination and/or viewing angle, and two or more part-areas of the coating are applied therewith, where the colours of at least two of the part-areas are different from one another under any illumination and/or viewing angle.

30. Process according to claim 28, characterised in that three or more coating compositions each comprise flake-form effect pigments or polymerisable and/or crosslinkable mesogenic materials which are different from one another and have different colour and/or brightness impressions depending on the illumination and/or viewing angle, and three or more part-areas of the coating are applied therewith, where the colours of three or more of the part-areas are different from one another under any illumination and/or viewing angle.

31. Process according to claim 28, characterised in that at least two directly adjacent part-areas whose colours are different from one another under any illumination and/or viewing angle are applied.

32. Process according to claim 28, characterised in that the coating compositions are applied in the form of a paint, a printing ink, a polymerisable and/or crosslinkable mesogenic composition or a polymeric film.

33. Process according to claim 28, characterised in that the substrate on the surface which is provided with the coating has entirely or partly a black, grey or other dark colour below the coating or is provided entirely or partly with a black, grey or other dark-coloured layer before it is coated with the coating composition.

34. Process according to claim 28, characterised in that the substrate on the surface which is provided with the coating is formed entirely or partly in a reflective manner below the coating or is provided entirely or partly with a reflective coating before it is coated with the coating composition.

35. A method of protecting an article against counterfeiting comprising attaching to said article an optically variable security element according to claim 1.

36. A method according to claim 35, where the articles are banknotes, cheques, credit cards, shares, passports, identity documents, driving licences, entry tickets, revenue stamps, ID cards, travel tickets, postage stamps, packaging materials, seals, labels or articles of daily use to be protected.

37. Banknotes, cheques, credit cards, shares, passports, identity documents, driving licences, entry tickets, revenue stamps, ID cards, travel tickets, postage stamps, packaging materials, seals, labels or articles of daily use to be protected, comprising an optically variable security element according to claim 1.

* * * * *

UNITED STATES PATENT AND TRADEMARK OFFICE

CERTIFICATE OF CORRECTION

PATENT NO. : 8,642,161 B2
APPLICATION NO. : 12/517155
DATED : February 4, 2014
INVENTOR(S) : Matthias Kuntz et al.

It is certified that error appears in the above-identified patent and that said Letters Patent is hereby corrected as shown below:

In the Claims:

Column 31, Line 62 reads: "crosslinked mesogenic material is a cholesterie, smectic or" should read -- crosslinked mesogenic material is a cholesteric, smetic or --.

Column 32, Line 3 reads: "mesogenic compound Which contains a polymerisable func-" should read -- mesogenic compound which contains a polymerisable func- --.

Signed and Sealed this
Third Day of June, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,642,161 B2
APPLICATION NO. : 12/517155
DATED : February 4, 2014
INVENTOR(S) : Kuntz et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 817 days.

Signed and Sealed this
Twenty-second Day of September, 2015

Michelle K. Lee

Michelle K. Lee
*Director of the United States Patent and Trademark Office*